US009683389B2

(12) United States Patent
Pintar et al.

(10) Patent No.: US 9,683,389 B2
(45) Date of Patent: Jun. 20, 2017

(54) MOVEMENT LOCK FOR A LOCKING ELEMENT OR AN ACTUATOR IN A LOCKING SYSTEM

(75) Inventors: Zeljko Pintar, Zossen/Nächt Neuendorf (DE); Ulrich Fischer, Hoppegarten (DE); Christopher Loeb-Ullmann, Berlin (DE)

(73) Assignee: ASSA ABLOY SICHERHEITSTECHNIK GMBH, Albstadt (DE)

( * ) Notice: Subject to any disclaimer, the term of this patent is extended or adjusted under 35 U.S.C. 154(b) by 565 days.

(21) Appl. No.: 13/989,525

(22) PCT Filed: Nov. 23, 2011

(86) PCT No.: PCT/DE2011/002057

§ 371 (c)(1),
(2), (4) Date: May 24, 2013

(87) PCT Pub. No.: WO2012/072066

PCT Pub. Date: Jun. 7, 2012

(65) Prior Publication Data

US 2013/0239630 A1 Sep. 19, 2013

(30) Foreign Application Priority Data

Nov. 26, 2010 (DE) ..... 10 2010 053 154

(51) Int. Cl.

| | |
|---|---|
| ***E05B 47/06*** | (2006.01) |
| ***E05B 33/00*** | (2006.01) |
| ***E05B 17/20*** | (2006.01) |
| ***E05B 49/00*** | (2006.01) |
| *E05B 15/04* | (2006.01) |

(52) U.S. Cl.

CPC ..... *E05B 33/00* (2013.01); *E05B 17/2092* (2013.01); *E05B 47/0611* (2013.01);

(Continued)

(58) Field of Classification Search

CPC ..... E05B 47/0611; E05B 17/2092; E05B 2015/0493; E05B 47/0619; E05B 47/0626;

(Continued)

(56) References Cited

U.S. PATENT DOCUMENTS 2,660,873 A * 12/1953 Bennett et al. ..... 70/133
3,719,248 A * 3/1973 Breitschwerdt et al. ..... 180/271

(Continued)

FOREIGN PATENT DOCUMENTS

DE 103 44 438 B3 12/2004
FR 2 849 083 A1 6/2004

(Continued)

OTHER PUBLICATIONS

International Search Report issued by the European Patent Office in International Application PCT/DE2011/002057.

*Primary Examiner* — Lloyd Gall
(74) *Attorney, Agent, or Firm* — Henry M. Feiereisen LLC

(57) ABSTRACT

The invention relates to a movement lock for a locking element or an actuator in a locking system which can be operated in a mechanical or mechatronic manner. Provision is made here for the movement lock to have a blocking element which can be brought into engagement with the locking element or actuator by a system which is maintained under tension or caused to move and can be triggered as a result of an external pulse application on the locking system.

6 Claims, 4 Drawing Sheets

(52) U.S. Cl.
CPC ..... *E05B 49/00* (2013.01); *E05B 2015/0493* (2013.01); *Y10T 70/70* (2015.04); *Y10T 70/7062* (2015.04)

(58) Field of Classification Search
CPC ..... E05B 47/0634; E05B 33/00; E05B 49/00; Y10T 70/7062; Y10T 70/70; Y10T 70/7012; Y10T 70/7751; Y10T 292/14
USPC ..... 70/278.3, 278.7, 279.1, 333 R, DIG. 52, 70/495, 496, 386; 292/DIG. 22, 252
See application file for complete search history.

(56) References Cited

U.S. PATENT DOCUMENTS 3,884,056 A * 5/1975 East et al. ..... 70/100
3,968,667 A * 7/1976 Gartner et al. ..... 70/303 A
5,473,922 A 12/1995 Bair et al.
5,542,274 A * 8/1996 Thordmark et al. ..... 70/495
5,632,170 A * 5/1997 Evans ..... 70/303 A
5,653,483 A * 8/1997 Grover ..... 292/194
5,839,307 A * 11/1998 Field et al. ..... 70/283
5,893,283 A * 4/1999 Evans et al. ..... 70/303 A
6,382,688 B1 * 5/2002 Agostini ..... 292/336.3
6,826,935 B2 * 12/2004 Gokcebay et al. ..... 70/278.3
7,007,528 B2 * 3/2006 Chong ..... E05B 29/004 70/383
7,640,773 B2 * 1/2010 Bellamy et al. ..... 70/496
8,544,303 B2 * 10/2013 Andersson ..... 70/278.7
2002/0134120 A1 * 9/2002 Davis ..... 70/278.3

FOREIGN PATENT DOCUMENTS

WO WO 01/48341 A1 7/2001
WO WO 2008/112346 A2 9/2008

* cited by examiner

MOVEMENT LOCK FOR A LOCKING ELEMENT OR AN ACTUATOR IN A LOCKING SYSTEM

CROSS-REFERENCES TO RELATED APPLICATIONS

This application is the U.S. National Stage of International Application No. PCT/DE2011/002057, filed Nov. 23, 2011, which designated the United States and has been published as International Publication No. WO 2012/072066 and which claims the priority of German Patent Application, Serial No. 10 2010 053 154.5, filed Nov. 26, 2010, pursuant to 35 U.S.C. 119(a)-(d).

BACKGROUND OF THE INVENTION

The invention relates to a movement lock for a locking element or an actuator in a locking system.

Lock cylinders, which not only have a mechanical structure, oftentimes include actuators that affect certain adjustment or blocking members within the lock cylinder and interact with these. This can, for example, involve a rotation or displacement of a component, such as a locking bar or a locking function to prevent rotation or displacement of the component.

This is based on the supposition that each component has, of course, a certain mass, which may potentially be caused to move as a result of physical energy in the locking system, like vibrations or an external pulse application, so that the function that should be realized for example during blocking of a rotation or movement, is no longer effective.

SUMMARY OF THE INVENTION

It is therefore an object of the invention to provide a solution that prevents an undesired or inadvertent movement of a locking element or an actuator.

This object is achieved according to the invention with a movement lock for a locking element or an actuator in a mechanical or mechatronically actuatable locking system, which is characterized in that the movement lock has a blocking element which can be brought into engagement with the locking element or actuator by a system which is maintained under tension or caused to move and can be triggered as a result of an external pulse application on the locking system.

Preferably, the blocking element can be brought temporarily into engagement with the locking element or actuator and can be reset by the legitimate actuation of the locking system.

Structurally, this movement lock can be designed in various ways, with preferred embodiments being set forth hereinafter.

According to one configuration, the blocking element includes a unilaterally supported pivot lever having a free end provided with a section or stop which can be brought into engagement with the actuator to lock its movement, and a tension spring which has one end connected to the pivot lever at a distance to the pivot lever bearing and another end being supported at a distance to the pivot lever bearing and offset thereto, and which is oriented and adjusted such that the pivot lever assumes an intermediate position when the tension spring is aligned substantially in prolongation of the pivot lever axis, in which position the spring is tensioned and is relaxed in deflections that are mirror images of one another, with one of the deflections of the pivot lever representing the rest or release position and the other deflection of the pivot lever representing the locking position, and with the pivot lever being swingable when released from the intermediate position into the locking position.

When the movement lock is intended for temporarily blocking the rotation of an actuator having a plurality of components, it is provided that one of the components of the actuator is an electrically-operated rotary lock which can be brought into engagement with a locking bar acting in a lock cylinder between a cylinder core and a cylinder housing in order to prevent a rotation of the cylinder core when a key has a wrong encoding, wherein the stop for the pivot lever remains in the rest or release position, when the lock cylinder is actuated in a normal way, and swings into the locking position in the presence of an external pulse application upon the components to prevent the movement of the rotary lock.

A mass, preferably a ball, can hereby be brought into contact with the pivot lever and is freely movable in a recess associated thereto and applies a momentum upon the pivot lever, when the pivot lever is acted upon by a pulse in its rest or release position so as to move the pivot lever away from the rest or release position into the locking position.

It is further provided that the pivot lever can be moved from the locking position via the intermediate position back to the rest or release position, when an authorized key for operating the locking system is withdrawn to thereby apply a momentum upon the pivot lever.

According to a further configuration, the rotor shaft of the actuator has a section which widens in a substantially rectangular manner in the manner of a cam and is rotatable between the opposing legs of a U-shaped reset frame, wherein the reset frame is freely movable in perpendicular relationship to the rotor shaft and one of the legs of the reset frame is able to bear upon one of the sides of the rectangular section by its own weight or by action of a spring, so that a free rotation of the rotor shaft can be prevented.

Viewed in direction of the rotor shaft, the section may hereby have two flat longitudinal surfaces disposed in confronting relation and connected in the shape of an arc by two transverse surfaces, wherein one of the legs of the reset frame rests upon the one longitudinal surface of the section, when the rotor shaft assumes the idle rotation position.

Another embodiment of the movement lock is characterized in that the locking element is a locking bar which acts between a cylinder core and a cylinder housing in a lock cylinder to prevent rotation of the cylinder core, when a key has the wrong encoding, and to liberate it when operation of the locking system is legitimate, wherein a pin is provided which is movable in relation to the locking bar, especially axially movable, and designed as blocking element, and which does not interfere in its rest position with the movement of the locking bar but is shifted axially when acted upon by an external pulse and prevents the movement of the locking bar by way of non-corresponding contact surfaces, with the rest position of the blocking element being retained by a retaining element which is displaceable transversely in relation to the blocking element, and with the retaining element being axially removable away from the blocking element by the pulse application in opposition to the force of a spring to thereby allow axial displacement of the blocking element.

In this context, it is further provided that in the presence of a legitimate locking when a key is inserted, a lever pin causes both the movement of the rotary lock to clear the movement of the locking bar and implementation of a displacement of the blocking element accompanied by a displacement of a coupling element, wherein the rest position of the blocking element is maintained by the retaining element in which rest position the non-corresponding support surfaces are in a position disengaged from the locking bar.

BRIEF DESCRIPTION OF THE DRAWING

The invention will now be explained in more detail with reference to the drawings. It is shown in.

DETAILED DESCRIPTION OF PREFERRED EMBODIMENTS

Figure 1:
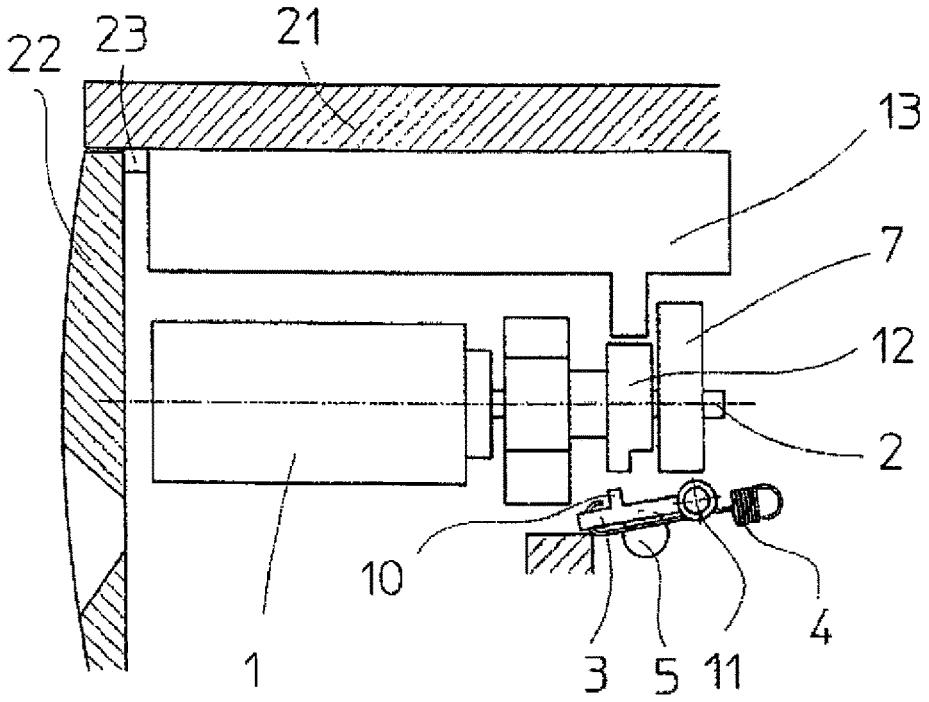
FIG. 1: schematically a part of a locking system, and more particularly the locking bar cooperating with the actuator in the normal locking condition.

In a locking system, not shown in detail, an electrically driven actuator 1 is provided for example in a lock cylinder housing 21 in which a cylinder core 22 is rotatably arranged, in which a not shown key can be inserted.

When an electronically encoded key is used in this locking system, an electrical signal to the actuator is transmitted in the presence of a matching key to cause the rotor shaft 2 to rotate into a position in which the locking bar 13 is released so that the latter is able to move radially inwardly, to emerge from the recess 23, and thus to clear the parting plane between the lock cylinder housing and cylinder core in a customary manner, thereby executing a locking process.

Vibrations or in particular an external pulse, for example a blow, could cause a slight rotary motion of the rotor shaft, even though the actuator is deactivated in the absence of a matching key.

In the worst case scenario, this may be sufficient to also liberate the locking bar or to permit an actuation, i.e. an unlocking operation could be executed.

Figure 2:
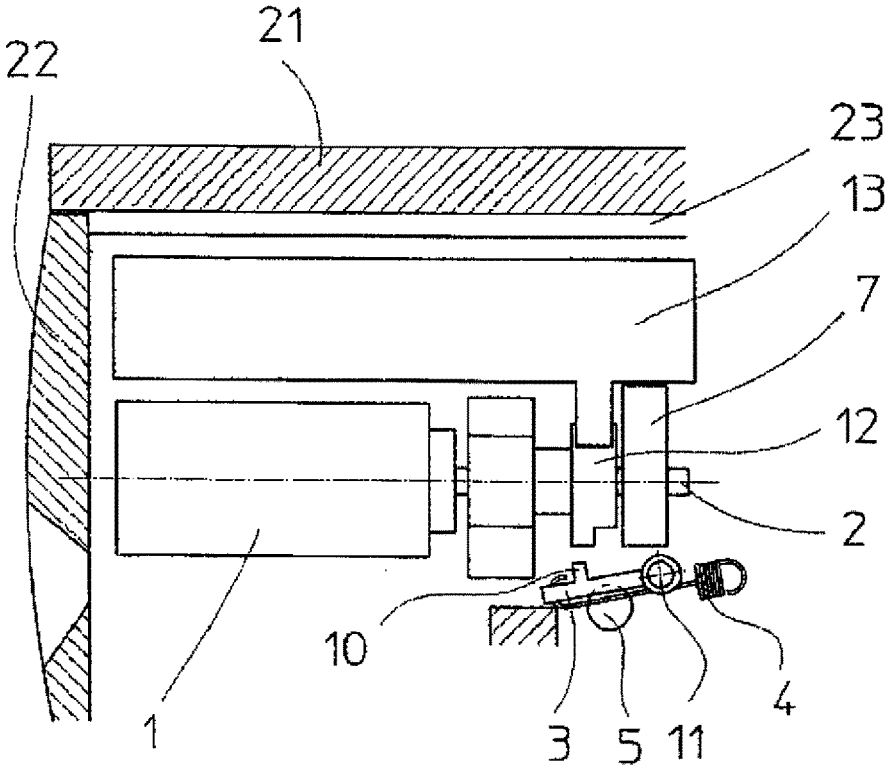
FIG. 2: the state that enables a locking.
Figure 3:
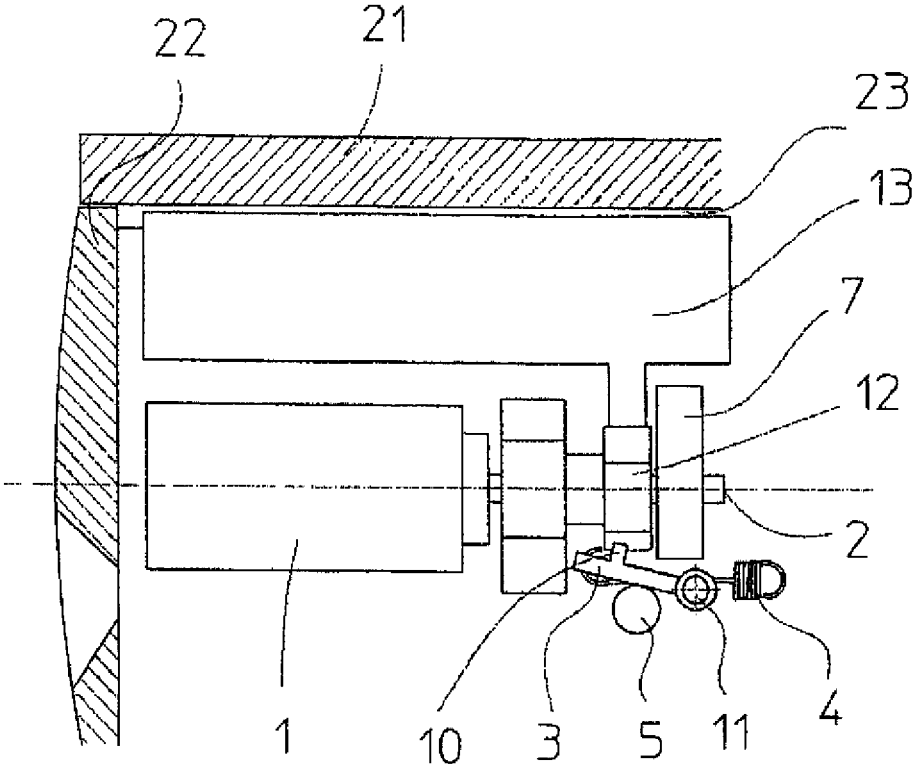
FIG. 3: the state when the movement lock is triggered.

According to the invention, as shown by way of an embodiment in FIGS. 1 to 3, a pivot lever 3 is provided, which is maintained under tension by a spring 4.

The spring 4 has a free end connected to the pivot lever 3 at its free end provided with a stop 10 and another end supported at a distance to a pivot lever bearing 11 and offset thereto.

In order for the pivot lever to be able to move and still being maintained under spring tension, the support for the pivot lever 3 and the spring 4 is slightly offset relative to one another.

It is essential that the spring 4 in the position shown in FIG. 1, the so-called rest or release position, is tensioned. Also, the spring is tensioned in the locking position which is shown in FIG. 3. The pivot lever has to overcome between these two positions a position in which the spring is slightly more tensioned.

As a result of an external pulse application, the pivot lever is moved from the rest or release position (FIG. 1) in such a way as to overcome the intermediate position and to swing into the locking position (FIG. 3).

This swinging motion past the intermediate position can be assisted by a freely moving ball 5 having a mass which is caused to move in response to a pulse from any direction and presses against the pivot lever, as shown in FIG. 3.

An additional safeguard against rotation of the actuator may also be realized by a so-called reset frame 7.

For that purpose, the rotor shaft 2 is provided with a wider section 6 in the manner of a cam.

Figure 4:
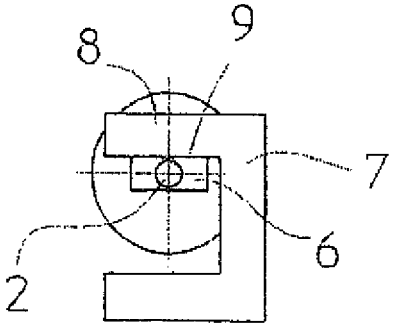
FIG. 4: the additional locking element in the form of a reset frame.

As shown in FIG. 4, this section 6 is embraced by the reset frame 7 which has a U-shaped configuration.

The reset frame 7 is freely movable in perpendicular relationship to the rotor shaft 2.

Since having, of course, an—albeit slight—mass, the reset frame will assume, due to gravity, the lowest position—with respect to its freedom of movement—as shown in FIG. 3. It may also be held by a spring in this preferred position.

Since the section 6, configured in the manner of a cam, on the rotor shaft is substantially rectangular in shape, the reset frame bears with its one, in this case, upper leg 8, upon the upper longitudinal surface 9 so that the weight or mass of the reset frame secures the rotor shaft in this position, and pushes the weight or mass back in the presence of an external pulse as a result of the shape of the section 6.

Figure 5:
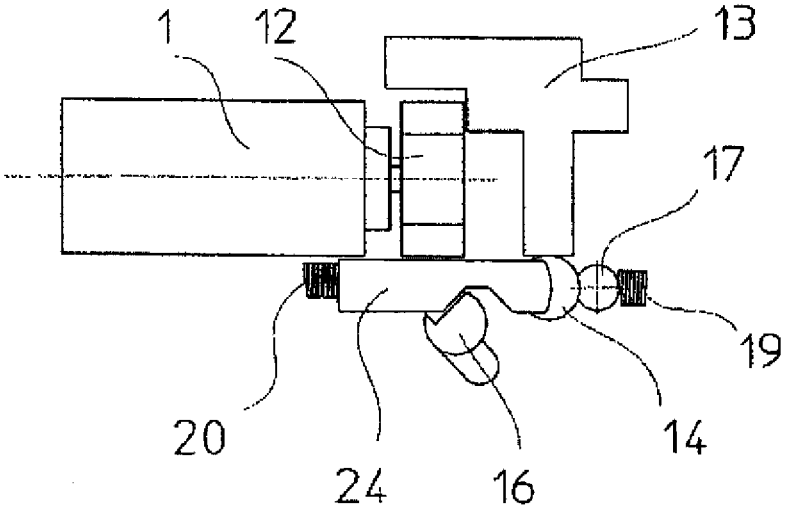
FIGS. 5-8: another embodiment in various views and states.
Figure 6:
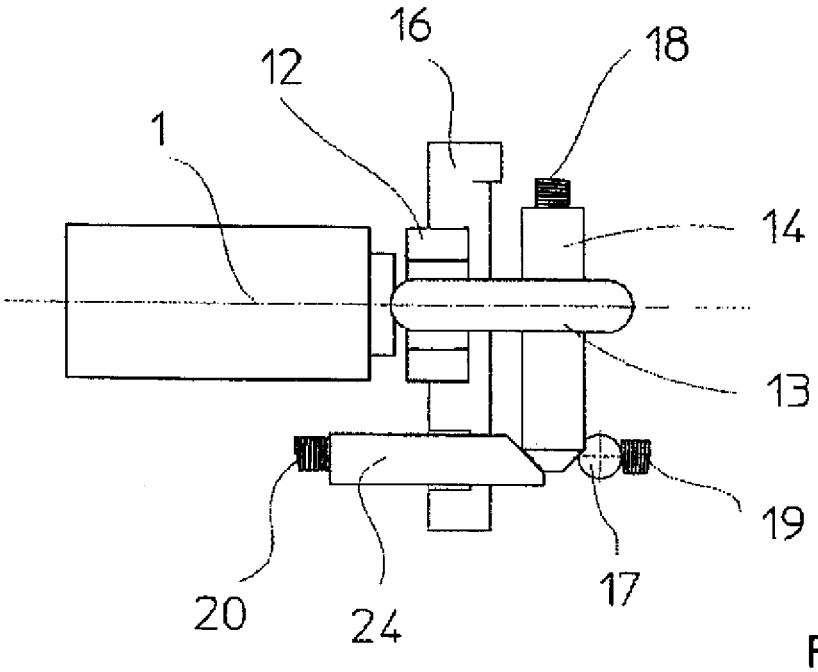
Figure 7:
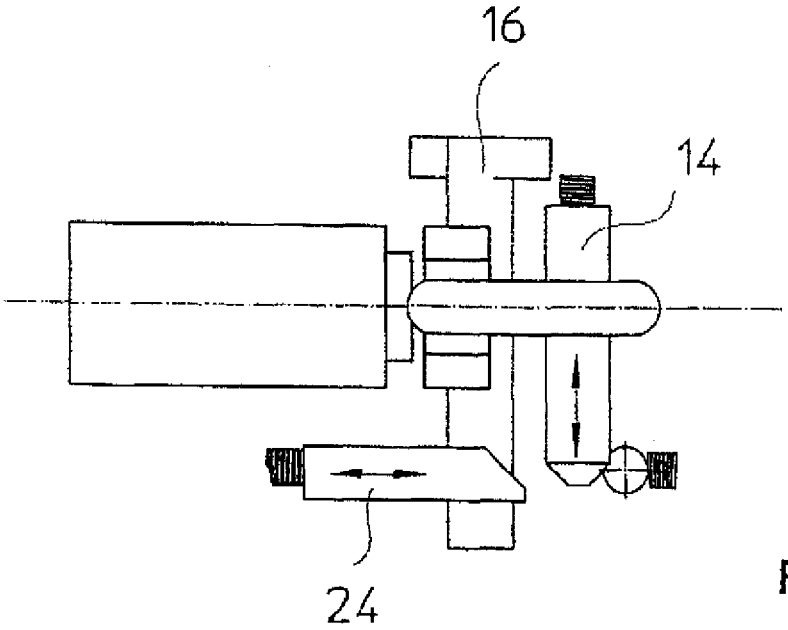
Figure 8:
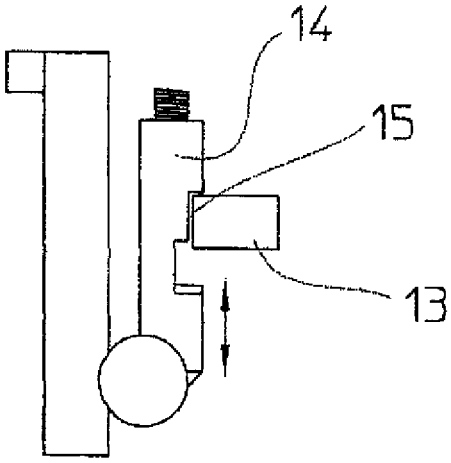

FIGS. 5-8 illustrate a further embodiment, with FIGS. 6 and 8 each showing a different view of the state shown in FIGS. 5 and 7 respectively.

Not shown in these figures is the lock cylinder whereas the locking bar acting again in a known manner between the latter and the cylinder core is designated by 13.

The locking bar 13 interacts hereby again with an electrically-operated actuator 1, i.e. when the electrically-operated actuator 1 is actuated with the rotary lock 12, the locking bar 13, depending on design, can be moved away from the position in which it locks the locking system and release the locking position or the electrically-operated actuator can be brought again with the rotary lock 12 into the position in which the locking bar 13 cannot be moved.

In this embodiment, a pin serving as blocking element 14 is provided which is spring-biased (spring 19) and axially (with respect to its longitudinal axis) shiftable (FIG. 5). This pin has, as shown in FIG. 8, vacuum recesses 15 which enable a radial mobility of the locking bar 13 depending on the axial position of the pin 14.

When assuming the axial position in which the radial movement of the locking bar is cleared, this pin is held by a retaining element 17—in this case a ball maintained under pressure by a spring ball 9 (FIG. 6).

When the locking system is acted upon by an external pulse, the retaining element 17 is axially displaced to the position shown in FIG. 8, thereby relaxing the spring 19. It can be seen that the locking bar cannot move radially due to the support in the upper recess so that the lock cylinder is blocked, i.e. no unlocking operation can be executed.

When inserting a key, not shown here, the lever pin 16 is turned and clears the coupling element 24 which is maintained under the pressure by a spring 20.

This coupling element 24 in turn presses—in opposition to the pressure of spring 19 or the retaining element 17—the blocking element 16 designed as pin, back into the starting position shown in FIG. 6.

The invention claimed is:

1. A movement lock, comprising a locking element;

an actuator;

a blocking element configured for engagement with the actuator, said blocking element being movable between a locking position and a release position;

a tension spring cooperating with said blocking element and applying a tension to said blocking element; and a ball cooperating with said blocking element and assisting a movement of the blocking element between the release position and the locking position, wherein the blocking element includes a pivot lever having a free end provided with a stop engageable with the actuator to lock movement of the actuator, wherein the tension spring has one end connected to the pivot lever on the free end provided with the stop and another end supported at a distance from a pivot lever bearing, so that the tension spring extends along the pivot lever, wherein the tension spring being configured such that the pivot lever assumes a position, in which position the tension spring is tensioned and is relaxed in deflections that are mirror images of one another, with one of the deflections of the pivot lever representing a rest or release position and another one of the deflections of the pivot lever representing a locking position, with the pivot lever being swingable when released from the rest or release position into the locking position.

2. The movement lock of claim 1, wherein the actuator has an electrically-operated rotary lock engageable with the locking element acting in a lock cylinder between a cylinder core and a cylinder housing in order to prevent a rotation of the cylinder core when a key has a wrong encoding, wherein the stop for the pivot lever remains in the rest or release position, when the lock cylinder is actuated in a normal way, and swings into the locking position in the presence of an external pulse application upon components of the actuator to prevent a movement of the rotary lock.

3. The movement lock of claim 1, wherein the ball is configured for contact with the pivot lever and freely movable to apply a momentum upon the pivot lever, when the pivot lever is acted upon by a pulse in the rest or release position so as to move the pivot lever away from the rest or release position into the locking position.

4. The movement lock of claim 1, further comprising a U-shaped reset frame being freely movable in perpendicular relationship to a rotor shaft of the actuator, said reset frame having opposing legs, with one of the legs of the reset frame configured to bear upon one side of a widening substantially rectangular section of the actuator so that a free rotation of the rotor shaft is preventable.

5. The movement lock of claim 4, wherein the section of the actuator as viewed in direction of the rotor shaft has two flat longitudinal surfaces disposed in confronting relation and connected by two transverse surfaces, wherein one of the legs of the reset frame rests upon the one longitudinal surface of the section, when the rotor shaft assumes an idle rotation position.

6. The movement lock of claim 1, wherein the blocking element is elongated and has two opposite ends, the tension spring acting on one of the ends of the elongated blocking element, while the ball is arranged to contact with and to act on a portion of the blocking element located between the ends of the blocking element.

* * * * *